US005683079A

United States Patent [19]

Ebrahimi

[11] Patent Number: 5,683,079

[45] Date of Patent: Nov. 4, 1997

[54] DOCUMENT PROCESSING APPARATUS

[75] Inventor: Ahmad Hojabr Ebrahimi, Dundee, Scotland

[73] Assignee: NCR Corporation, Dayton, Ohio

[21] Appl. No.: 493,659

[22] Filed: Jun. 22, 1995

[30] Foreign Application Priority Data

Sep. 19, 1994 [GB] United Kingdom ..... 9418844

[51] Int. Cl.[6] ..... B65H 7/02

[52] U.S. Cl. ..... 271/258.01; 271/265.01; 271/273; 271/188; 271/902; 209/534; 209/583

[58] Field of Search ..... 209/534, 583, 209/659, 702, 942; 271/188, 209, 273, 274, 265.01, 258.01, 902

[56] References Cited

U.S. PATENT DOCUMENTS

| | | | |
|---|---|---|---|
| 4,227,801 | 10/1980 | Arnoldi et al. . | |
| 4,469,319 | 9/1984 | Robb et al. . | |
| 4,589,650 | 5/1986 | Miyoshi | 291/188 |
| 5,037,082 | 8/1991 | Roller . | |
| 5,507,481 | 4/1996 | Meyer et al. | 271/902 |

FOREIGN PATENT DOCUMENTS

| | | | |
|---|---|---|---|
| 48802 | 2/1988 | Japan | 271/188 |
| 0127559 | 5/1989 | Japan | 271/209 |
| 0192661 | 8/1989 | Japan | 271/188 |
| 403143865 | 6/1991 | Japan | 271/188 |

OTHER PUBLICATIONS

Patent Abstracts Of Japan, unexamined applications, M field, vol. 13, No. 122, Mar. 27, 1989, The Patent Office Japanese Government, p. 89 M 807; & JP-A-63 295 331 (Konica Corp.).

*Primary Examiner*—H. Grant Skaggs
*Attorney, Agent, or Firm*—Michael Chan

[57] ABSTRACT

In a document processing apparatus, transport means feed a document along a track past one or more processing devices such as scanning means or printing means. The apparatus includes first and second corrugating rolls (44, 45) between which a document is fed. The rolls (44, 45) are arranged to produce a plurality of corrugations (122) in the document (120) prior to the document reaching the processing device or devices. The corrugations (122) are shallow, being not more than one millimeter in depth, these corrugations (122) producing satisfactory stiffening and straightening of the document (120) while having no adverse effect so far as reading information from, or printing information on, the document (120) is concerned.

4 Claims, 7 Drawing Sheets

DOCUMENT PROCESSING APPARATUS

BACKGROUND OF THE INVENTION

This invention relates to a document processing apparatus of the kind including transport means for feeding a document along a track past at least one processing device, such as reading means or printing means.

The invention has application, for example, to a depository apparatus included in an automated teller machine (ATM) of the kind which is arranged to carry out a financial transaction, such as dispensing currency notes or accepting a deposit in the form of an envelope or a single sheet financial document such as a cheque or payment slip. As is well known, in operation of an ATM of this kind, a user inserts a customer identification card into the machine and then enters certain data (such as a personal identification number, type of transaction, etc.) on one or more keyboards included in a user interface of the machine. The machine will then process the transaction, dispense currency notes or accept a deposit item as may be requested, and return the card to the user as part of a routine operation. If an envelope is to be deposited, the user typically inserts the envelope through a deposit entry slot in the user interface, and the depository apparatus of the ATM transports the envelope to a printing location and then deposits it in a container included in the apparatus. If a single sheet financial document is deposited, the document is transported to reading and printing means for automatic processing of the document, after which the document is deposited in separate container means.

In some prior document processing apparatuses of the kind specified, problems have been experienced due to a document being bent or curled to some extent. Examples of such problems are that unsatisfactory printing or incorrect reading may take place, or that jamming of a document may occur at the interface of document guide means and a processing device.

From EP-A-0038918 and U.S. Pat. No. 3917260 there are known currency note handling apparatuses in which currency notes are fed to a receptacle for stacking therein, and each of which includes corrugating means for producing in a note corrugations extending parallel to the direction of feed of the note, the corrugations serving to stiffen a limp note so as to facilitate stacking thereof. Neither of these documents is concerned with the problems that may occur when feeding a document along a track past a processing device such as information reading means or printing means. Further, no information is given in these documents regarding the depth of the corrugations.

It is an object of the invention to provide a document processing apparatus in which the above mentioned problems are alleviated.

SUMMARY OF THE INVENTION

According to the invention there is provided a document processing apparatus including transport means for feeding a document along a track past at least one processing device, characterized by corrugating means arranged to produce a plurality of corrugations in said document prior to said document reaching said at least one processing device, said corrugations extending generally parallel to the direction of feed along said track, and serving substantially to straighten said document in the direction of feed.

Preferably, the corrugations produced by the corrugating means of a document processing apparatus in accordance with the invention have a depth of not greater than one millimeter. It has been found that corrugations having such a depth produce satisfactory stiffening and straightening of a document while having no adverse effect so far as reading information from, or printing information on, a document is concerned.

BRIEF DESCRIPTION OF THE DRAWINGS

A document processing apparatus in accordance with the invention will now be described by way of example with reference to the accompanying drawings, in which.

DETAILED DESCRIPTION

Figure 1:
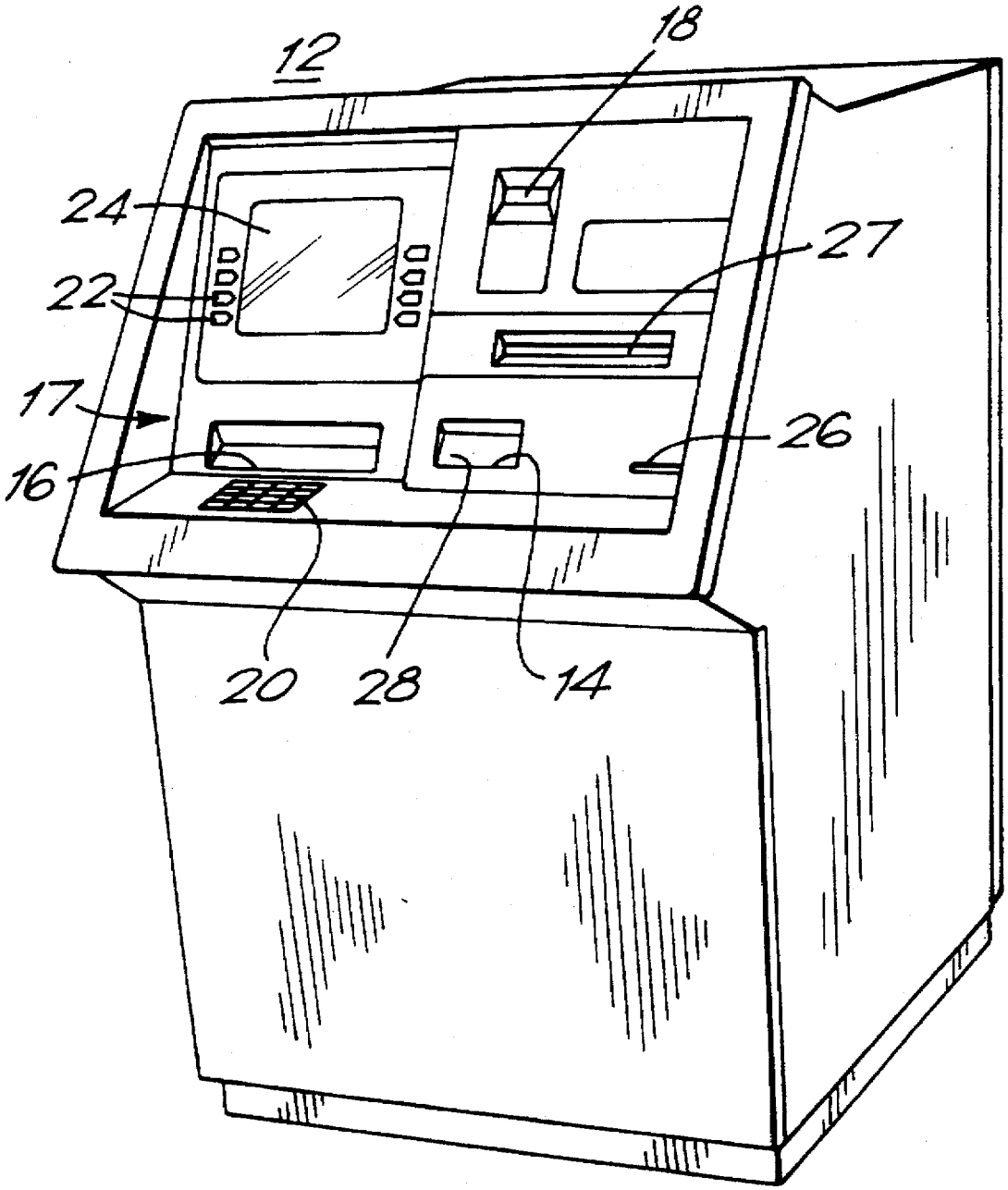
FIG. 1 is a perspective view of an ATM including a depository apparatus which incorporates a document processing apparatus according to the invention.
Figure 2A:
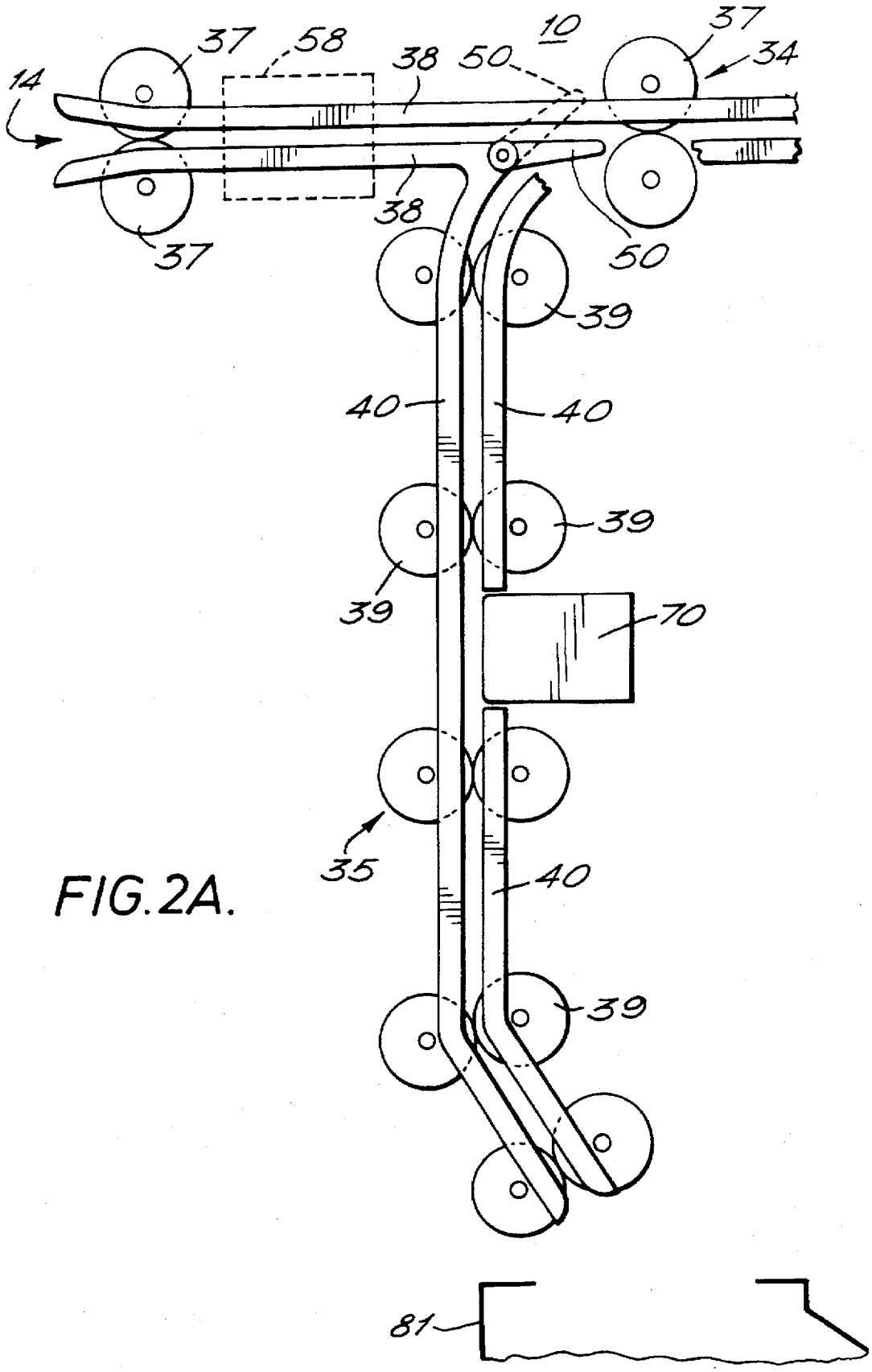
FIGS. 2A and 2B taken together are a schematic side elevational view of the depository apparatus.
Figure 6:
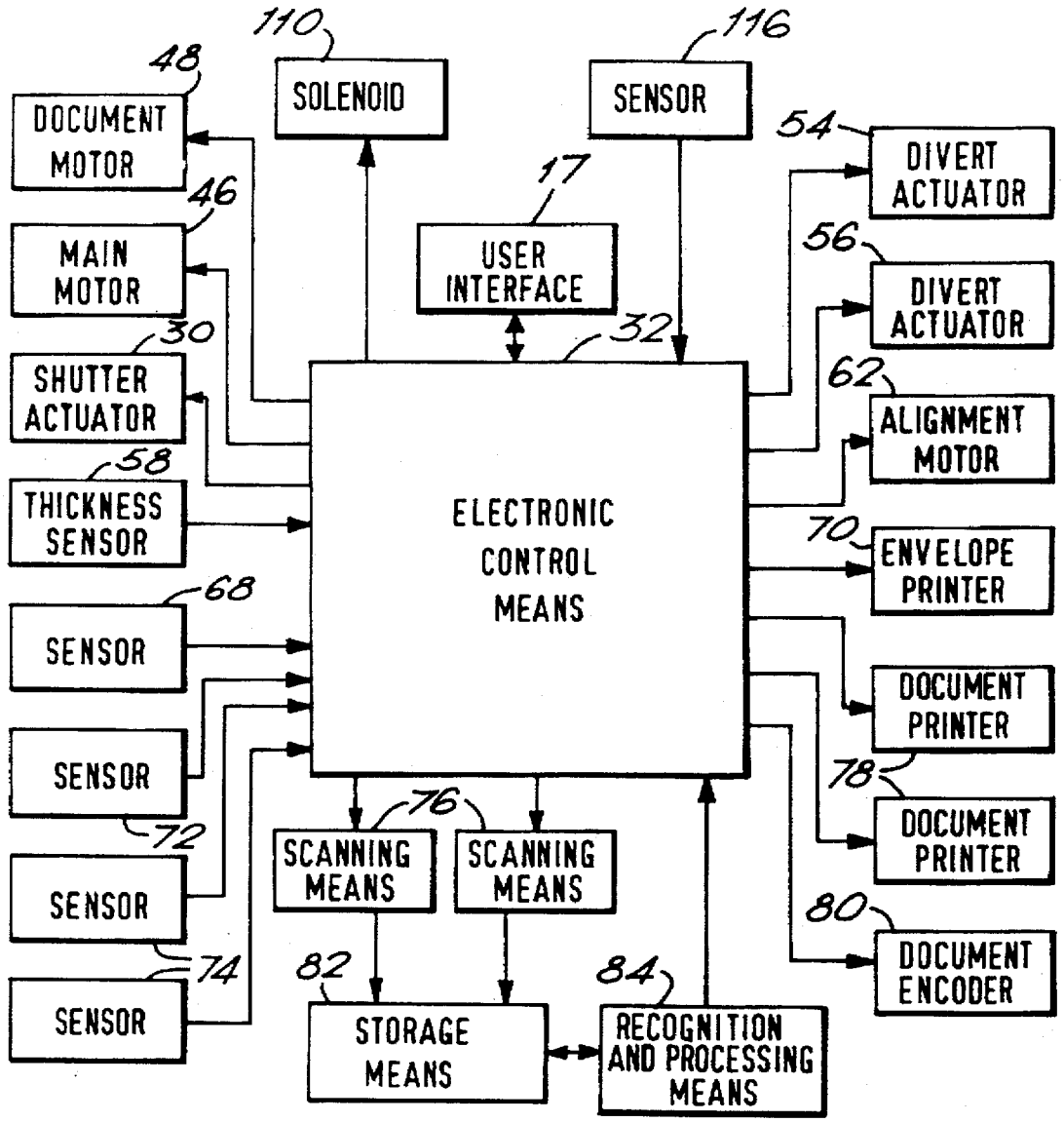
FIG. 6 is a schematic block diagram illustrating the electrical interconnections of parts of the depository apparatus.

Referring first to FIGS. 1, 2A and 6 of the drawings, a depository 10 is incorporated in an ATM 12 adapted to accept deposit items, represented by envelopes containing money (currency notes and/or cheques) or single sheet financial documents such as cheques or payment slips, through an entry slot 14, and to dispense currency notes through a slot 16, the slots 14 and 16 being included in a user interface 17 of the ATM 12. It should be noted that, in the following description, the term deposit item will be used to mean a deposited envelope or single sheet financial document. The user interface 17 also includes a card entry slot 18 through which a user of the machine inserts a customer identification card, a keyboard 20 and control keys 22 on which the user enters data such as a personal identification number (PIN) and the required transaction details, a lead-through display screen 24 on which user instructions and other information are displayed, a receipt slot 26 through which receipts are issued to a user, and a slot 27 through which envelopes are dispensed on request to a user.

The entry slot 14 for deposit items is normally closed by a shutter 28 (not shown in FIG. 2A) connected to an actuating mechanism 30 (FIG. 6). Operation of the actuating mechanism 30 serves to retract the shutter 28 from its closed position so as to permit deposit items to be inserted in the depository 10 through the slot 14. Operation of the actuating mechanism 30 along with operation of other elements of the ATM 12 is controlled by electronic control means 32 as indicated in FIG. 6.

Figure 2B:
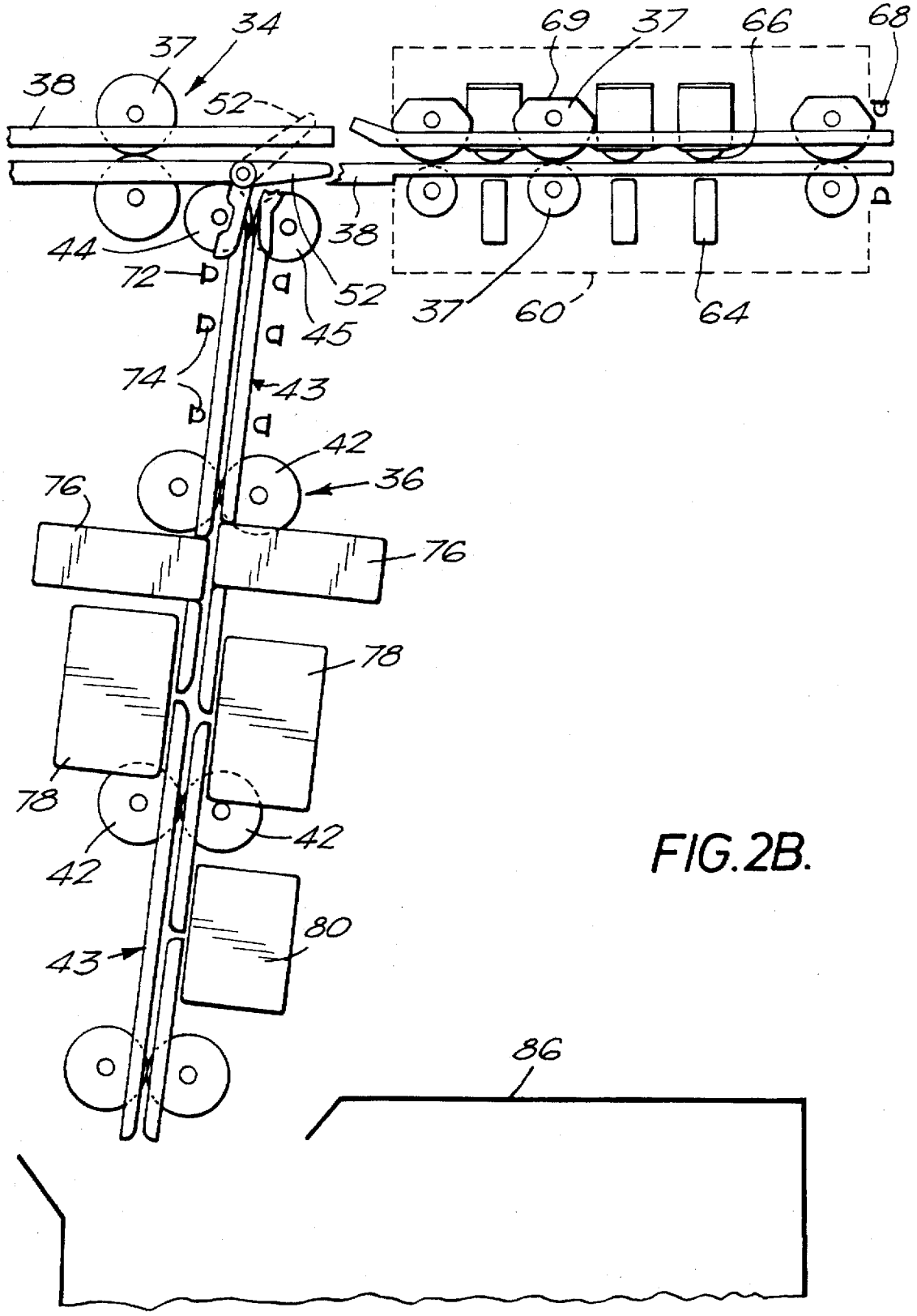

Referring now particularly to FIGS. 2A and 2B, the depository 10 has a transport mechanism which comprises a common transport section 34, an envelope transport section 35 and a document transport section 36. The common transport section 34 includes a first plurality of feed rolls 37 for transporting deposit items from the entry slot 14 along a common feed path defined by guide means 38. The envelope transport section 35 includes a second plurality of feed rolls 39 for transporting envelopes along an envelope feed path defined by guide means 40, and the document transport section 36 includes a third plurality of feed rolls 42 for transporting documents along a feed path defined by guide means 43; in addition, the document transport section 36 includes corrugator rolls 44 and 45 which will be described later with reference to FIGS. 3 to 5. Each of the envelope and document feed paths branch off from the common feed path. The feed rolls 37 and 39 and the corrugator rolls 44 are driven by a main reversible transport motor 46 (FIG. 6), whereas the feed rolls 42 are driven by a separate reversible motor 48 (FIG. 6). A pivotably mounted divert gate 50 is positioned at the junction between the common feed path and the envelope feed path, and a further pivotably mounted divert gate 52 is positioned at the junction between the common feed path and the document feed path. The divert gates 50 and 52 are normally in the home positions shown in solid outline in FIGS. 2A and 2B, but are each selectively movable to an operational position shown in chain outline under the control of a respective associated actuator 54 or 56 (FIG. 6).

A thickness sensor 58 is positioned adjacent to the entry slot 14 of the depository 10, the sensor 58 being arranged to detect whether a deposit item has a thickness of at least one millimeter, which in the present embodiment is taken as being indicative that the deposit item is an envelope. If the thickness sensor 58 senses that a deposited item has a thickness of at least one millimeter, then it sends an appropriate output signal to the electronic control means 32. The thickness sensor 58 may be of known construction and operation. For example, the thickness sensor 58 may include two cooperating rolls (not shown) which are moved apart as a deposit item passes between them, the above-mentioned output signal being generated if the rolls are moved apart by at least one millimeter.

An alignment mechanism 60 is positioned adjacent to the end of the common feed path remote from the entry slot 14. The alignment mechanism 60 serves to align a deposit item which is a single sheet document (i.e. a deposit item having a thickness of less than one millimeter) by moving the document transversely relative to the common feed path so as to bring a long edge of the document into engagement with a reference surface which is accurately parallel to the document feed path and which is formed by a side plate 61 (FIGS. 4 and 5) of a supporting framework of the depository 10. When a document has been correctly aligned in this manner it has the correct orientation relative to the document feed path so that it is processed correctly as it is fed along the document feed path. The alignment mechanism 60 is operated by an alignment motor 62 (FIG. 6). The alignment mechanism 60 may include cooperating gripper means 64 and 66 which are normally out of engagement with each other so as to allow free passage of a deposit item from left to right (with reference to FIGS. 2A and 2B) along the common feed path. When a deposit item reaches its rightmost position along the feed path, as sensed by an optical sensor 68, its movement is stopped. If at this time the thickness sensor 58 has not generated an output signal, thereby normally indicating that the deposit item is a single sheet document, then the gripper means 64 and 66 are operated so as to engage with the document and move the document into engagement with the side plate 61; when the gripper means 64 and 66 are operated, the feed rolls 37 are stopped, with flat peripheral portions 69 of upper feed rolls 37 included in the alignment mechanism 60 being out of engagement with the associated lower feed rolls 37. It should be understood that if the thickness generator 58 has generated an output signal, thereby normally indicating that the deposit item is an envelope, then the alignment mechanism 60 remains non-operative.

If the thickness sensor 58 indicates that the deposit item is an envelope, the divert gate 52 remains in its home position but the divert gate 50 is moved to its actuated position as shown in chain outline in FIG. 2A. The operation of the motor 46 is then reversed so as to cause the common transport section 34 to move the envelope back along the common feed path towards the entry slot 14. Before reaching the entry slot 14, the envelope is diverted by the diverter gate 50 into the envelope transport section 35.

Referring to FIG. 2A, an envelope printer 70 is associated with the envelope transport section 35. The printer 70 serves to print on an envelope fed along the envelope transport path appropriate information such as a serial number identifying the envelope, time and date.

Referring now particularly to FIG. 2B, if the thickness indicator 58 indicates that a deposit item is considered to be a single sheet document, then after the deposit item has been transported to the rightmost position along the common feed path the divert gate 52 is moved to its actuated position as shown in dotted outline. After having been aligned, the deposit item is moved by the common transport section 34 back along the common feed path towards the entry slot 14. Shortly after this reverse movement commences, the deposit item is diverted by the divert gate 52 into the document transport section 36 where the deposit item first passes between the corrugator rolls 44 and 45 the function of which will be described later.

Associated with the transport section 36 are a leading edge optical sensor 72 positioned adjacent to the entrance to the document transport section 36, side edge optical sensors 74, two scanning means 76 located on opposite sides of the document feed path and each including a respective line scan camera, two printers 78 also located on opposite sides of the document feed path, and a thermal encoder 80, all of these elements being coupled to the electronic control means 32. A predetermined time after the leading edge of a deposit item entering the document transport section 36 is sensed by the sensor 72, the item is stopped momentarily and the outputs of the side edge sensors 74 are checked by the electronic control means 32 in order to ascertain if the item is correctly aligned relative to the document transport path. (If both edge sensors 74 sense a side edge portion of the deposit item then the item is correctly aligned). If the deposit item is not correctly aligned, the operation of the document transport motor 48 is reversed so as to feed the item back to the alignment mechanism 60 where the alignment operation is repeated. The procedure of aligning a deposit item and checking its alignment is repeated if necessary up to three times. If after three repeated alignment procedures the deposit item is still not correctly aligned, it is either fed back by the common transport section 34 along the common feed path to the entry slot 14 for collection by the user, or the item is diverted by the divert gate 50 into the envelope transport section 35 for feeding to an envelope bin 81 from where it can be collected for manual processing.

If after entering the document transport section 36 a deposit item is found to be correctly aligned, then the line scan cameras included in the scanning means 76 are switched on and the document transport section 36 recommences feeding of the deposit item along the document feed path, the item being guided by the guide means 43 and moving past the cameras of the scanning means 76. The scanning carried out by each of the scanning means 76 generates in known manner a stream of bits of data which are stored in associated storage means 82 (FIG. 6) to build up a two dimensional digital image of each side of the deposit item. After the scanning procedure has been completed, the deposit item is again temporarily stopped and the stored digital images are read by associated recognition and processing means 84 (FIG.6). At the same time, the scanning means 76 enable a grey scale visual image of the deposit item to be displayed on the screen 24. The recognition and processing means 84 determines if the deposit item is a cheque by ascertaining whether a sort code, an account number and a cheque number are present at predetermined locations on one side of the cheque. The recognition and processing means 84 also determines if the deposit item is a payment slip by ascertaining whether certain information is present at predetermined locations on one or both sides of the deposit item. In addition, the recognition and processing means 84 checks whether the deposit item has been fully completed by the user (e.g. by being signed, dated and having amount information entered thereon in the case of a cheque), and whether the deposit item has been inserted into the entry slot 14 with the correct orientation so that it has the correct orientation relative to the scanning means 76 for proper processing. If the deposit item has not been fully completed or is incorrectly orientated, this situation will normally be made apparent to the user by virtue of the visual image of the deposit item displayed on the screen 24. If such situation is found to exist, then the operation of the document transport motor 48 is reversed so as to return the deposit item to the common feed path, after which the item is driven back along the common feed path by the common transport section 34 for return to the user via the entry slot 14. The user then has the opportunity to complete the deposit item or orientate it correctly, as the case may be, prior to reinserting the item into the entry slot 14.

If the recognition and processing means 84 determines that a deposit item is a financial document of predetermined type (i.e. a cheque or payment slip of a type recognized by the recognition and processing means 84) and that the document has been fully completed and has the correct orientation, then after being given the opportunity to view the image of the document on the screen 24 the user is requested by a message on the screen 24 to confirm by operation of one of the control keys 22 that processing of the document should continue. If the user makes such confirmation, then the relevant information carried by the document is processed in known manner by the recognition and processing means 84, and feeding of the document along the document feed path by the document transport section 36 is resumed. If the user fails to make such confirmation, then the document is returned to the user in the manner previously described.

If the recognition and processing means 84 fails to recognize a deposit item as being either a cheque or a payment slip or an envelope (which may happen if a non-standard cheque or payment slip or an envelope not dispensed by the ATM 12 has been deposited by the user), then again the operation of the document motor 48 is reversed so as to return the deposit item to the common feed path. Again the deposit item is driven back along the common feed path by the common transport section 34 but in this case the divert gate 50 remains in its home position so that the deposit item is returned to the entry slot 14 for collection by the user.

As mentioned above, if the recognition and processing means 84 determines that a deposit item is a cheque or payment slip, the feeding of the document along the document feed path is resumed, the document again being guided by the guide means 43. During this further movement, the document passes the printers 78 which carry out a printing operation on one or both sides of the document. The printed information may, for example, comprise a serial number identifying the document, date, time and ATM location. The document then moves past the thermal encoder means 80. If the document is a cheque and the recognition and processing means 84 has been able to read the monetary amount written on the cheque, then the encoder means 80 prints a code line representing this amount in magnetic ink on the cheque. Finally, the document is fed by the document transport section 36 to a document bin module 86 where the document is stacked in orderly manner in an appropriate pocket of the bin module 86.

Figure 3:
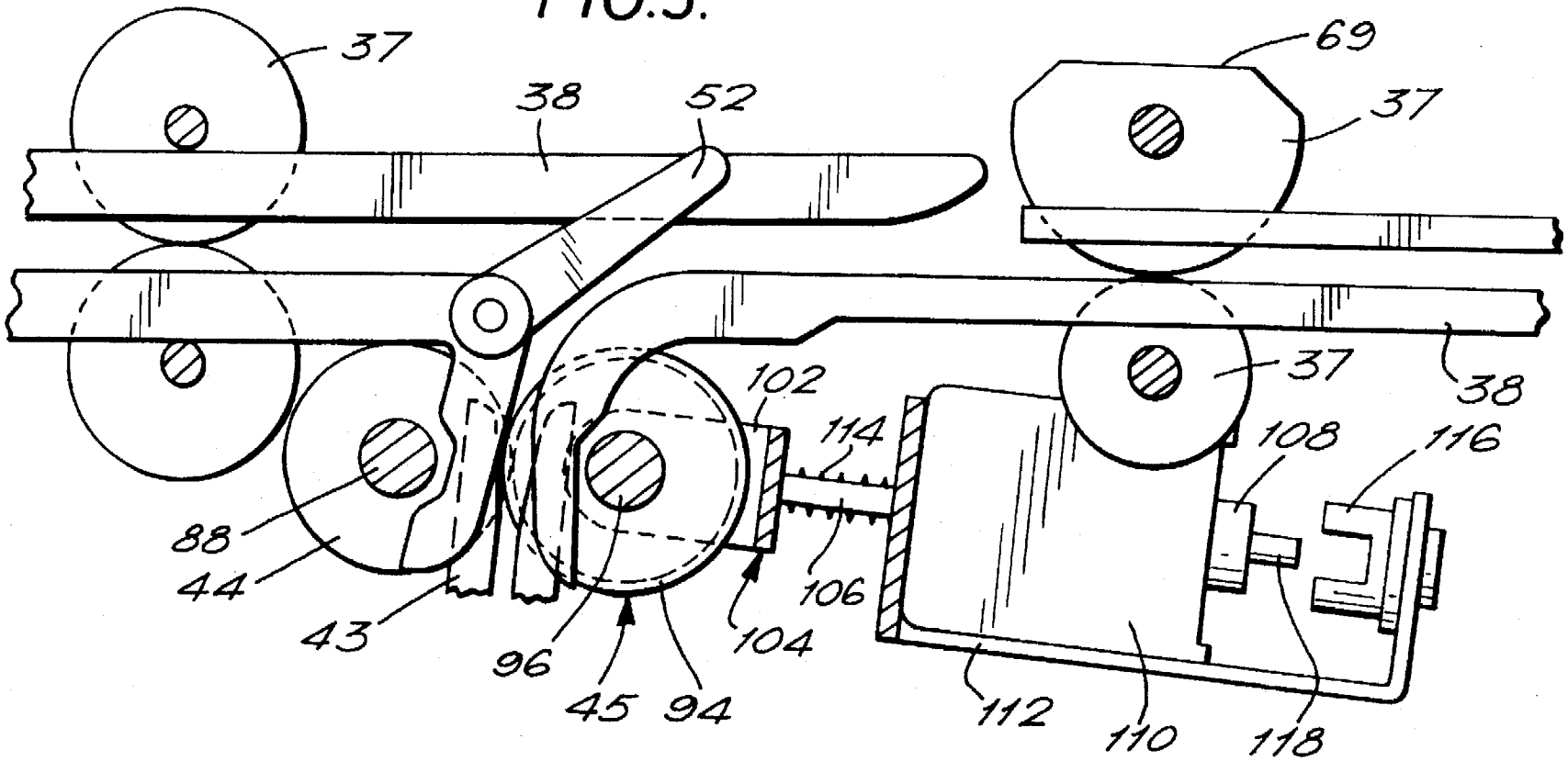
FIG. 3 is an enlarged side elevational view of a corrugating mechanism included in the document processing apparatus according to the invention, with the corrugating mechanism being shown in an operated condition.
Figure 4:
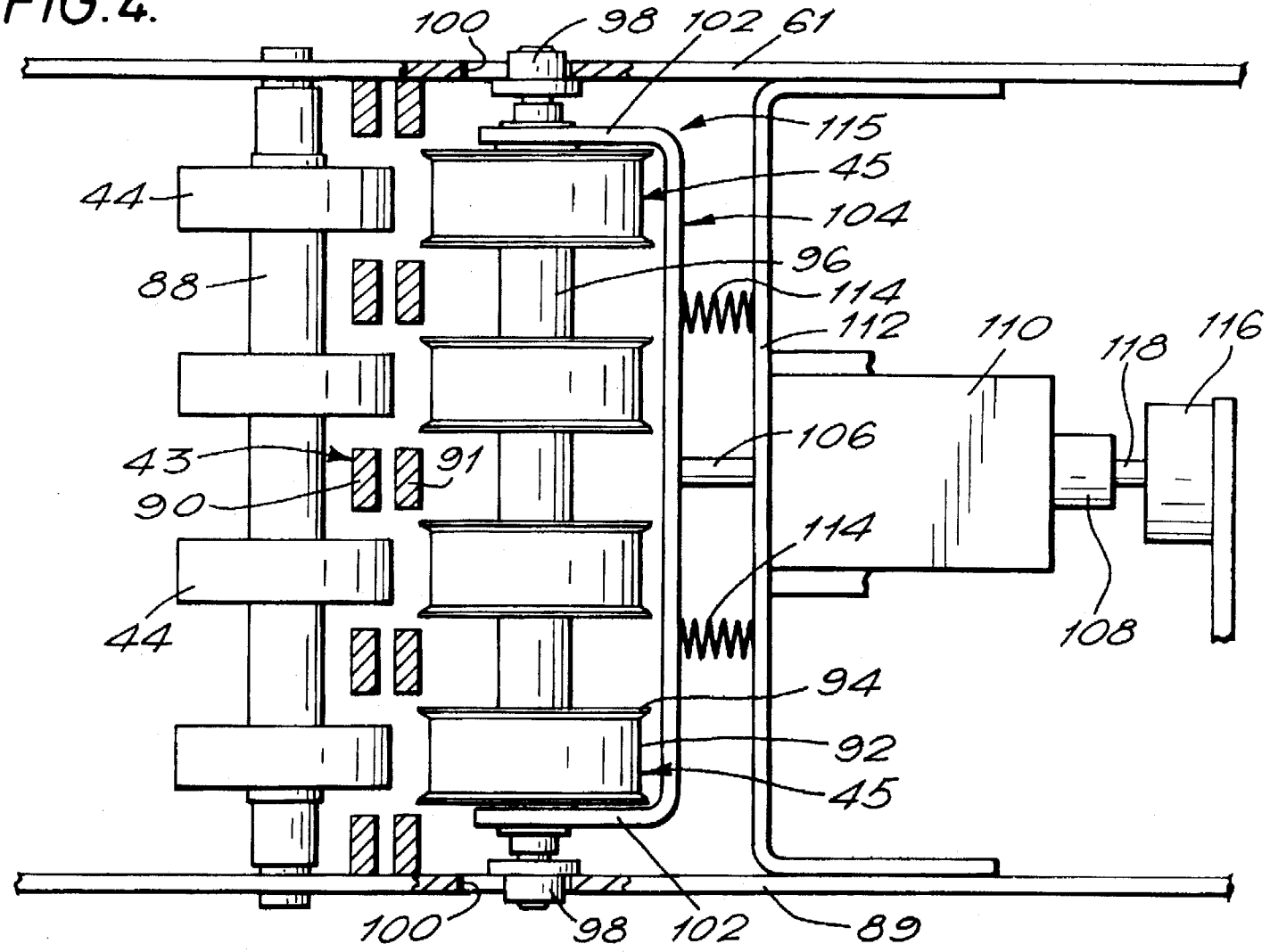
FIG. 4 is a plan view of the corrugating mechanism of FIG. 3 but showing the mechanism in a non-operated condition.
Figure 5:
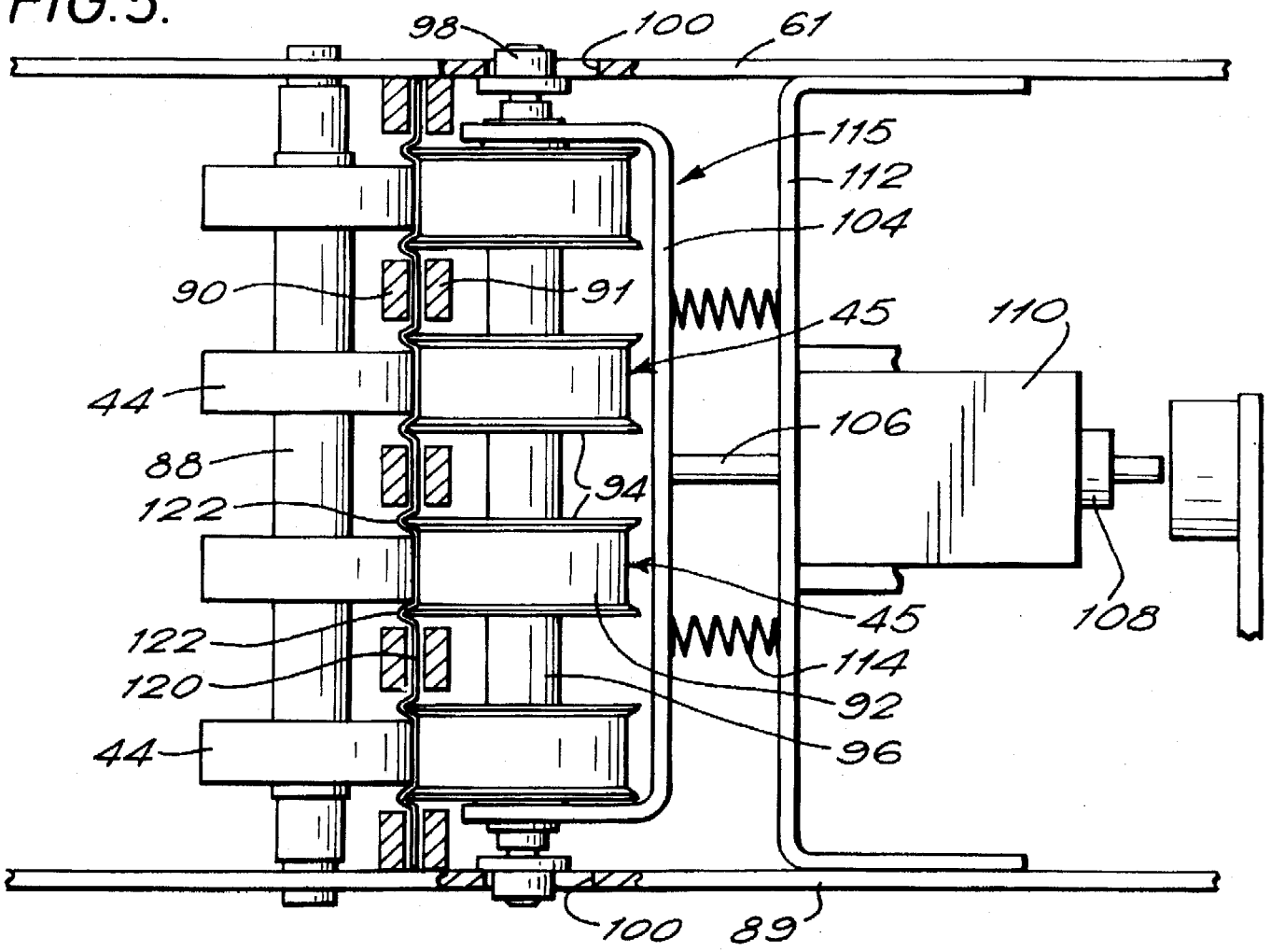
FIG. 5 is a plan view similar to FIG. 4 but showing the corrugating mechanism in an operated condition.

Referring now particularly to FIGS. 3 to 5, the corrugator rolls 44 are of rubber and have a smooth circumference, the rolls 44 being secured on a drive shaft 88 which extends between, and is rotatably mounted with respect to, the side plate 61 and an oppositely positioned side plate 89 of the supporting framework of the depository 10. The drive shaft 88 is driven via gear means (not shown) by the motor 46. The corrugator rolls 44 are respectively associated with the corrugator rolls 45 which are relatively hard compared with the rolls 44, the rolls 45 being made of a hard plastics material such as nylon. The rolls 44 and 45 are located between generally vertically extending cooperating guide portions 90 and 91 of the guide means 43 as shown in FIGS. 4 and 5. Each roll 45 has a central portion 92 having a smooth circumference and a width slightly greater than that of the rolls 44 with two flanges being respectively provided at the sides of the central portion 92 so as to form two circumferential ridges 94. The ridges 94 of each roll 45 project proud of the circumference of the central portion 92 by about 1.5 millimeters and, as seen in FIGS. 4 and 5, the ridges 94 are symmetrically positioned, and offset slightly, with respect to the sides of the associated roll 44.

The rolls 45 are rotatably mounted on a shaft 96 the ends of which are provided with bearings 98 which are respectively slidably mounted in horizontally extending slots 100 formed in the side walls 61 and 89. The shaft 96 is also supported by side portions 102 of a movable bracket 104 which is connected by a rod 106 to an armature 108 of a solenoid 110. The solenoid 110 is mounted on a fixed bracket 112 which extends between, and is secured to, the side walls 61 and 89. The movable bracket 104 is connected to the fixed bracket 112 by return springs 114 which serve to urge the assembly 115 of the bracket 104, the shaft 96 and the rolls 45 towards the bracket 112 and into the home position shown in FIG. 4 when the solenoid 110 is in a deactivated condition. The deactivated condition of the solenoid 110 is sensed by an optical sensor 116 which is arranged to sense an extended portion 118 of the armature 108 when the armature 108 is in its rightmost position with reference to FIGS. 3 to 5. In the event of a document jam or other fault occurring in the transport section 34 or 36, the sensor 116 sends to the electronic control means 32 a signal indicative of whether the solenoid 110 is in an activated or deactivated condition. When the solenoid 110 is activated, the armature 108 is moved to its leftmost position so as to move the assembly 115 into the position shown in FIGS. 3 and 5 against the action of the springs 114, with the shaft bearings 98 sliding along the slots 100. With the assembly 115 in this last-mentioned position, the rolls 45 are in cooperative relationship with the rolls 44. If at this time a document 120 has been fed into the document transport section 36 with the document 120 located between the cooperating guide portions 90 and 91 and between the rolls 44 and the central portions 92 of the rolls 45 as shown in FIG. 5, then as the document 120 is fed along the document transport path the rolls 44 are rotated by the motor 46, with the rolls 45 in contact with the document 120 and freely rotating on the shaft 96. The ridges 94 of the rolls impart longitudinal corrugations or recesses 122 to the document 120, again as shown in FIG. 5. Each of these corrugations or recesses 122 preferably has a depth of not more than one millimeter and typically has a depth of about 0.25 millimeter. These corrugations 122 effectively straighten the document 120 in the direction of feed so that there is substantially no curl or bend in the document in this direction. Moreover, in view of the shallow nature of the corrugations 122, the corrugations 122 have no adverse effect on a subsequent processing operation carried out on the document 120 by the recognition and processing means 84 or by the printers 78 or encoder 80. After a corrugating operation on a document such as the document 120 has been completed, the solenoid 110 is deactivated and the springs 114 return the assembly 115 to its home position shown in FIG. 4.

In operation of the depository 10, a user inserts his identification card into the card entry slot 18 and enters his PIN on the keyboard 20. A deposit transaction is then requested by the user using the control keys 22 and, if desired, he can request the ATM 12 to dispense an envelope, again by using the control keys 22. In response to the deposit transaction request being made, the shutter 28 is retracted by the actuating mechanism 30 and the user can then insert a deposit item into the entry slot 14. If the deposit item is identified by the depository 10 as an envelope, the envelope is directed into the envelope transport section 35, wherein information is printed thereon by the printer 70, the envelope being eventually deposited in the envelope bin 81.

If the thickness indicator 58 indicates that a deposit item is considered to be a single sheet document, then the solenoid 110 is energized so as to bring the corrugator rolls 45 into cooperative relationship with the corrugator rolls 44, and the divert gate 52 diverts the deposit item into the document transport section 36 with the item first passing between the corrugator rolls 44 and 45 so as to have longitudinal corrugations imparted thereto. As previously mentioned, a predetermined time after the leading edge of the deposit item is sensed by the sensor 72, the item is stopped momentarily and the outputs of the side edge sensors 74 are checked by the electronic control means 32. At this time the deposit item has passed fully between the corrugator rolls 44 and 45, and the electronic control means 32 now brings about deactivation of the solenoid 110, the springs 114 returning the assembly 115 to its home position shown in FIG. 4. It should be understood that the electronic control means 32 maintains the solenoid 110 in a deactivated condition until the indicator 58 next indicates that a new deposit item is considered to be a document. The processing of the deposit item within the document transport section 36 then proceeds as previously described. Thus, if the deposit item is identified by the recognition and processing means 84 as a document then an image of the document is displayed on the screen 24. Provided the user confirms that he wishes the document deposit transaction to proceed, by use of one of the control keys 22, processing of the document continues, with the document being eventually deposited in the document bin module 86.

The depository 10 described above has the advantage that each document which enters the document transport section 36 is straightened by the longitudinal corrugations imparted thereto, thereby removing any curl or bend in the document in the direction of feed. This straightening of the document serves to eliminate the occurrence of jams in the document transport section 36 at the interface of the guide means 43 with the various processing devices represented by the scanning means 76, the printers 78 and the encoder 80. At the same time, the corrugations in the document are sufficiently shallow that none of the scanning, printing and encoding processes are adversely affected. Thus, the depository 10 is found to be highly reliable in operation.

I claim:

1. An apparatus comprising:

at least one processing device;

transport means for feeding a document along a track past said at least one processing device; and corrugating means for producing a plurality of corrugations in the document prior to the document reaching said at least one processing device, said corrugations extending generally parallel to the direction of feed along the track, and serving substantially to straighten the document in the direction of feed;

said corrugating means including a plurality of first rolls respectively associated with a plurality of second rolls, a document to be corrugated passing between said first rolls and said second rolls;

said second rolls being mounted so as to be movable towards and away from said first rolls between a first corrugating position and a second non-corrugating position.

2. An apparatus according to claim 1, further comprising control means, and wherein said transport means is arranged to feed the document along the track from a first location to a second location where a determination is made by said control means as to whether the document meets a predetermined condition, the document passing between and being corrugated by said first and second rolls while being fed from said first location to said second location, said transport means being arranged to feed the document back along the track to said first location if the document does not meet said predetermined condition, said second rolls being moved to said non-corrugating position prior to the document being fed back along the track.

3. An apparatus comprising:

at least one processing device;

transport means for feeding a document along a track past said at least one processing device; and corrugating means for producing a plurality of corrugations in the document prior to the document reaching said at least one processing device, said corrugating means producing in a document corrugations having a depth of not greater than one millimeter, said corrugations extending generally parallel to the direction of feed along the track, and serving substantially to straighten the document in the direction of feed;

said corrugating means including a plurality of first rolls respectively associated with a plurality of second rolls, a document to be corrugated passing between said first rolls and said second rolls;

said second rolls being mounted so as to be movable towards and away from said first rolls between a first corrugating position and a second non-corrugating position.

4. An apparatus according to claim 3, further comprising control means, and wherein said transport means is arranged to feed the document along the track from a first location to a second location where a determination is made by said control means as to whether the document meets a predetermined condition, the document passing between and being corrugated by said first and second rolls while being fed from said first location to said second location, said transport means being arranged to feed the document back along the track to said first location if the document does not meet said predetermined condition, said second rolls being moved to said non-corrugating position prior to the document being fed back along the track.

* * * * *